US006868648B2

(12) United States Patent
Glover et al.

(10) Patent No.: US 6,868,648 B2
(45) Date of Patent: Mar. 22, 2005

(54) FENESTRATION SEALED FRAME, INSULATING GLAZING PANELS

(75) Inventors: Michael Glover, Ottawa (CA); Stephen Field, Ottawa (CA)

(73) Assignee: Bowmead Holdings Inc., Ottawa (CA)

( * ) Notice: Subject to any disclaimer, the term of this patent is extended or adjusted under 35 U.S.C. 154(b) by 0 days.

(21) Appl. No.: 10/852,100

(22) Filed: May 25, 2004

(65) Prior Publication Data

US 2004/0211134 A1 Oct. 28, 2004

Related U.S. Application Data

(63) Continuation of application No. 10/089,726, filed as application No. PCT/CA00/01180 on Oct. 6, 2000, now abandoned.

(51) Int. Cl.[7] ..... E04C 2/54

(52) U.S. Cl. ..... 52/786.1; 52/793.1; 52/786.13; 52/DIG. 17

(58) Field of Search ..... 52/783.11, 784.1, 52/786.1, 786.11, 793.1, 786.13, 800.14, 204.6, 204.5, DIG. 17

(56) References Cited

U.S. PATENT DOCUMENTS

| | | | |
|---|---|---|---|
| 3,024,880 | A | 3/1962 | Burmeister |
| 3,401,496 | A | 9/1968 | Zopnek |
| 3,425,163 | A | 2/1969 | Horgan, Jr. |
| 3,775,914 | A | 12/1973 | Patil |
| 4,035,539 | A | 7/1977 | Luboshez |
| 4,198,796 | A | 4/1980 | Foster |
| 4,464,874 | A | 8/1984 | Shea et al. |
| 4,608,796 | A | 9/1986 | Shea, Jr. |
| 4,817,354 | A | 4/1989 | Bayer |
| 5,124,185 | A | 6/1992 | Kerr et al. |
| 5,622,019 | A | 4/1997 | Dorough, Jr. |
| 5,653,073 | A | 8/1997 | Palmer |
| 5,771,640 | A | 6/1998 | Back |
| 5,834,124 | A | 11/1998 | Pease et al. |
| 6,115,989 | A | 9/2000 | Boone et al. |
| 6,286,288 | B1 | 9/2001 | France |
| 6,463,706 | B1 | 10/2002 | Guhl et al. |

FOREIGN PATENT DOCUMENTS

| | | |
|---|---|---|
| DE | 25 27 013 | 1/1976 |
| DE | 89 01 593 | 3/1989 |
| DE | 40 07 365 | 9/1991 |
| EP | 0 328 823 | 8/1989 |
| FR | 1 459 169 | 2/1967 |
| FR | 2 653 470 | 4/1991 |
| FR | 2 708 030 | 1/1995 |
| WO | 91 08366 | 6/1991 |
| WO | 99 14169 | 3/1999 |

*Primary Examiner*—Brian E. Glessner
(74) *Attorney, Agent, or Firm*—Wenderoth, Lind & Ponack L.L.P.

(57) ABSTRACT

A fenestration sealed frame insulating glazing panel has an integral planar frame formed by four rigid plastic profiles interconnected end-to-end to define corners, the profiles having a low heat conductivity. Two glazing sheets are arranged in a spaced parallel relationship attached on opposite sides of the frame in a rigid manner by thermosetting adhesive to form an integral structure having an insulating cavity enclosed by the frame. The front face of each frame profile facing towards the cavity is covered by a low permeability sealant. The sealed frame glazing panel can include a third glazing sheet positioned in parallel between the first two glazing sheets and likewise interconnected at its perimeter to the frame to divide the insulating cavity into two parallel coextensive sub-cavities. The profiles of the frame can be made from structural plastic foam material, glass fiber, oriented thermoplastic, or various other materials of low thermal conductivity.

12 Claims, 14 Drawing Sheets

FENESTRATION SEALED FRAME, INSULATING GLAZING PANELS

This is a continuation application of Ser. No. 10/089,726, filed Apr. 4, 2002, now abandoned, which is a National Stage of International Application No. PCT/CA00/01180, filed Oct. 6, 2000.

BACKGROUND OF THE INVENTION

1. Field of the Invention

This invention relates generally to glazing-and-frame construction and more particularly to fenestration sealed frame, insulating glazing panels.

2. Description of the Prior Art

A conventional window consists of an insulating glass unit supported within a separate frame. Traditionally, the frame was made from wood or metal profiles, but increasingly plastic profiles made from such materials as polyvinyl chloride (PVC) or pultruded fibreglass are being substituted.

A traditional insulating glass unit generally consists of two or more glass sheets that are typically separated by a hollow aluminum spacer bar that is filled with desiccant bead material. With a conventional dual-seal unit, thermoplastic polyisobutylene material is applied to the spacer sides, and the outward facing channel between the glazing sheets and the spacer is filled with structural thermosetting sealant.

Because of the high thermal conductivity of the aluminum spacer, various efforts have been made in recent years to manufacture the hollow spacer from rigid low conductive plastic material. U.S. Pat. No. 4,564,540 issued to Davies describes the substitution of a rigid hollow fibreglass pultrusion for the aluminum spacer. Although a substantial development effort was carried out, this product has not yet been successfully commercialized and the technical problems include moisture wicking at the corners, glass stress breakage, and poor argon gas retention.

One solution to the problem of glass stress breakage is to manufacture the spacer from flexible material. U.S. Pat. No. 4,831,799 issued to Glover et al describes a flexible rubber foam spacer that is desiccant-filled with pre-applied pressure sensitive adhesive on the spacer sides. This flexible foam spacer has been commercialized under the name of Super Spacer®. In addition to featuring a low conductive spacer, another innovative feature of a Super Spacer® edge seal is that the traditional roles of the two perimeter seals are reversed. The inner PSA seal is the structural seal, while the outer seal is the moisture/gas barrier seal that is typically produced using hot melt butyl sealant.

In the past ten years, other warm-edge technologies have been developed where the traditional aluminum spacer has been replaced by a spacer made from a more insulating material, and these other warm-edge technologies include PPG's Intercept® and AFG's Comfort Seal® product. In total, these thermally improved warm-edge technologies have now gained about an 80 per cent share of the North American market.

In addition to reducing perimeter heat loss, these new warm edge products can also improve the efficiency and the speed of manufacturing the insulating glass units. These system improvements include manufacturing the edge seal as a metal re-enforced butyl strip (Tremco's Swiggle Seal®); roll forming the metal spacer and incorporating a butyl desiccant matrix and an outer butyl sealant (PPG's Intercept®); and manufacturing the spacer from EPDM foam with pre-applied butyl sealant and a desiccant matrix (AFG's Comfort Seal®). Although these improvements allow for the automated production of insulating glass units, residential sash windows still tend to be manufactured using largely manual assembly methods and typically, window frame fabrication is more labor intensive than sealed unit production.

One way of improving window assembly productivity is to fully integrate the frame and sealed unit assembly. In the presentation notes for the talk entitled *Extreme Performance Warm-Edge Technology and Integrated IG/Window Production Systems* given at *InterGlass Metal* '97, Glover describes a PVC sealed frame window system developed by Meeth Fenester in Germany. With this system, there is one continuous IG/window production line and using an automated four point welder, a PVC window frame is assembled around a double glazed unit. As noted in the paper, some of the concerns with the Meeth system include a problem of broken glass replacement, recycling/disposal of PVC window frames, and the technical risks of no drainage holes.

For window energy efficiency, most of the recent focus has been on improving the thermal performance of insulating glass units. Increasingly, it is being realized that substantial additional improvements will only be feasible through the development of new window frame types and technology. In a technical paper entitled *Second Generation Super Windows and Total Solar Home Powered Heating*, and presented at the *Window Innovations* '95 world conference in Toronto, Canada, Glover describes a second generation Super Window consisting of an exterior high performance triple glazed window and an interior high performance double glazed panel. By using motorized hardware, both the exterior and interior windows overlap the wall opening and this allows for a significant increase in solar gains and overall energy efficiency. However although significant energy efficiency improvements are achieved, the installation of the conventional casement window is very complex and this is primarily due to the extended width of the conventional window frame.

SUMMARY OF THE INVENTION

The present invention provides a fenestration sealed frame insulating glazing panel having an integral generally planar frame that is formed by a number of rigid plastic profiles having interconnected ends that define corners of the frame. The plastic profiles are fabricated of a material that has a low heat conductivity compared to aluminum and a coefficient of expansion that is similar to that of glass. Two glazing sheets are arranged in a spaced parallel relationship and attached to opposite sides of the frame to define therewith a sealed insulating cavity. Each framing profile in section has a portion that is overlapped by the sheets, and the overlapped portion of each framing profile defines on opposite sides thereof an elongated seat to receive a marginal edge region of a corresponding one of the glazing sheets. Each framing profile has a front face that is located between the elongated seats and is directed into the cavity. The glazing sheets are adhered to the seats by a structural sealant material that exhibits thermosetting properties. A low permeability sealant covers the front face of each of the frame profiles and extends towards the structural sealant on opposite sides of each framing profile to provide a continuous seal between the glazing sheets around the periphery of the cavity.

The low permeability sealant that is exposed to the interior of the cavity can incorporate desiccant material.

Preferably there is a decorative strip provided around the perimeter of each glazing sheet to cover or mask the structural sealant.

The rigid plastic profiles can be provided in many different forms, such as glass fiber filled thermoplastic extrusions, glass fiber pultrusions, glass fibre thermoplastic extrusions reinforced with thermoplastic pultruded strips, oriented thermoplastic extrusions, and structural thermoplastic foam extrusions. Whatever material is used in these rigid plastic profiles, it should have a heat conductivity that is low compared to aluminum. Preferably the heat conductivity would be less than 1/100 that of aluminum. For example, whereas the thermal conductivity of aluminum is 160 W/m° C., the thermal conductivity of fibreglass is 0.3 W/m° C., and that of expanded polystyrene foam is 0.03 W/m° C.

A vapor barrier sheet film material can be applied to the front face of each framing profile, and the low permeability sealants may be hot melt butyl or polyisobutylene.

The structural sealant is preferably made from thermosetting silicone material, and an alternative preferred material option is for the structural sealant and the low permeability sealant to be a single material that has both thermoplastic and thermosetting properties, for example in modified silicone material or a reactive hot melt butyl material.

A third glazing sheet can be positioned between the two outer glazing sheets and this third glazing sheet which is the same shape but smaller in size than the outer glazing sheets. Typically, this third glazing sheet is directly adhered to a stepped frame profile.

The fenestration sealed frame insulating glazing panel of the invention may be utilized as a door or a window panel in an exterior building wall. Where the panel is mounted to be moveable, suitable operating devices are attached to the plastic frame for connection to an operating mechanism in the window or door frame in the building wall. When used as a window, one preferred option is for the glazing panel to be mounted in an overlapping relationship to an opening in the wall of the exterior side thereof.

In an alternative configuration the glazing panel in accordance with the invention may be utilized to provide ribbon windows in a building wall. In this arrangement, each panel is positioned so that it spans between top and bottom supports, the side edges of adjacent panels being in abutment but otherwise being unsupported.

The fenestration sealed frame glazing insulating panel of the present invention is self supporting and may be designed to carry structural loads, in this case the glazing sheets being made of laminated glass. In such a stressed skin structural panel, the glazing sheets are preferably spaced apart by at least 70 mm, and the panel can incorporate a passage through which air can enter and leave the interior cavity, such passage incorporating desiccant to remove moisture from air that enters the cavity between the sheets.

BRIEF DESCRIPTION OF DRAWINGS

The following is a description by way of example of certain embodiments of the present invention, reference being made to the accompanying drawings, in which.

DETAILED DESCRIPTION OF THE PREFERRED EMBODIMENTS

Figure 1:
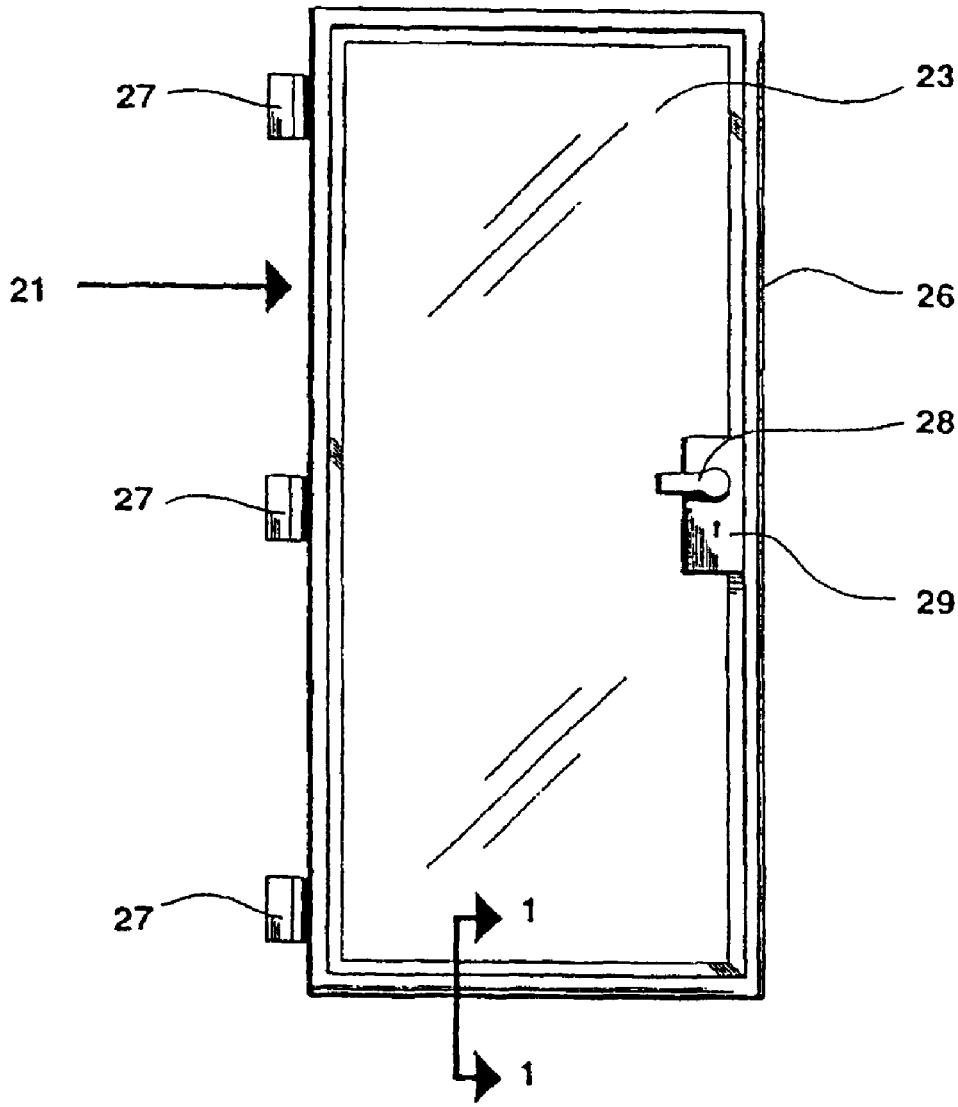
FIG. 1 shows an elevation view of an exterior sealed frame, triple glazed sash door panel.

Referring to the drawings, FIG. 1 shows an elevation view of a sealed frame, triple-glazed panel 21 that functions as an operable exterior door. The glazing door panel 21 consists of three glazing sheets 23, 24 (not shown) and 25 (not shown) that are adhered to a narrow width perimeter frame 26. The panel 21 is edge supported using hinges 27 that are mechanically attached to the narrow width perimeter frame. The handle and locking mechanism 28 for the operable door are incorporated in a rectangular panel 29 that forms part of the outer perimeter frame 26. The glazing door panels are typically made from heat strengthened or tempered glass sheets, although rigid clear plastic sheets can be substituted.

Although an entrance door is illustrated in FIG. 1, sealed frame construction can also be used for other glass door types including patio and accordion doors. For these different door assemblies, sealed frame construction creates a visually attractive, slim-line aesthetic as well as improved overall energy efficiency. According to the Canadian energy rating system, a conventional double-glazed, wood frame door can have an energy rating of ER minus 30. In contrast, a sealed frame, triple-glazed door incorporating energy efficient features such as low-e coatings and argon gas fill can have an energy rating as high as ER plus 15. The reasons for the dramatic performance improvement are twofold. First, low-e coatings and inert gas improve thermal performance and reduce heat loss. Second, with higher performance glazing, there is no drawback if the glazing area is increased. With the narrow sealed-frame profile widths, the glazing area can be increased by over 30 per cent, and this results in increased solar gains and higher energy efficiency.

Figure 2:
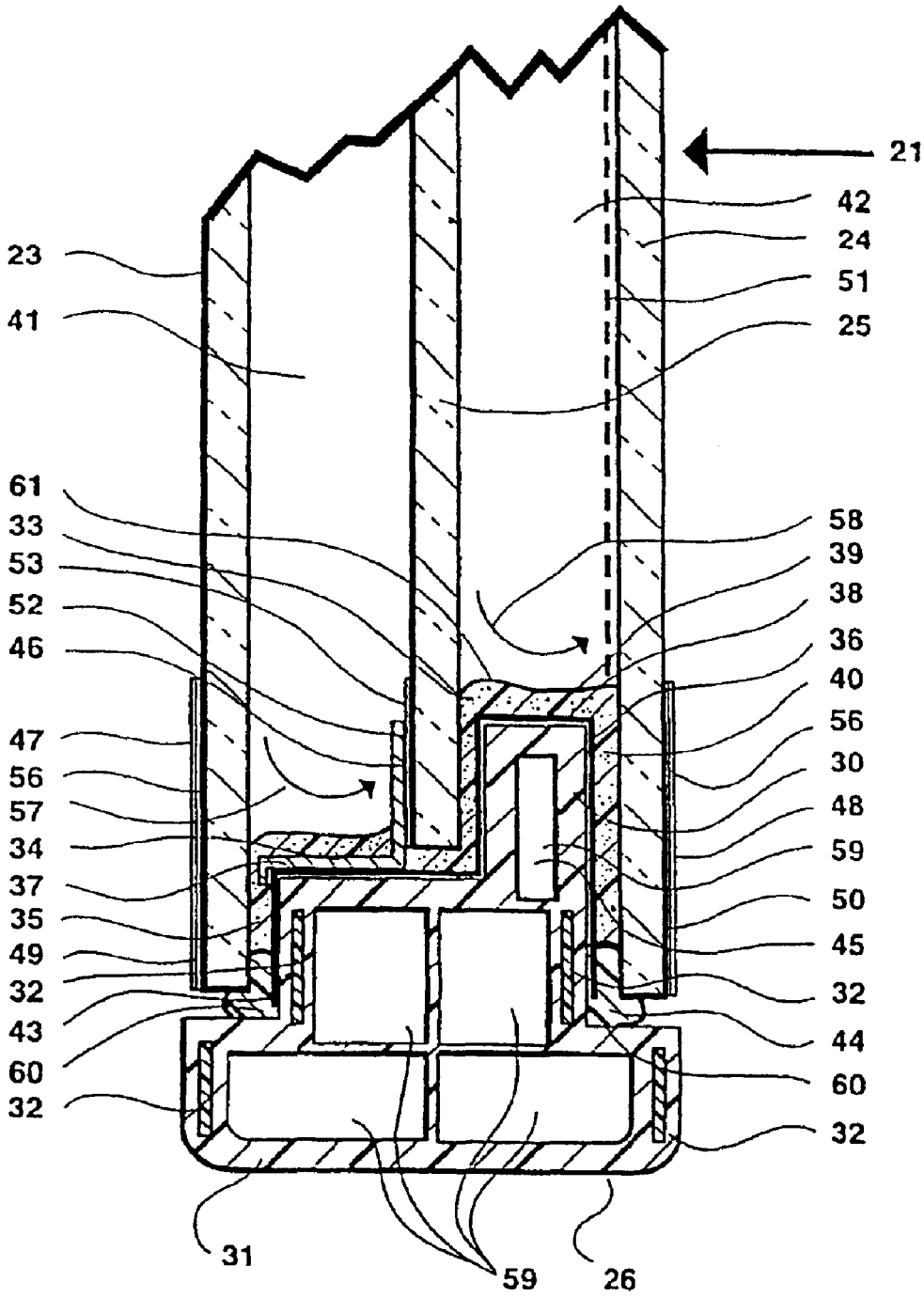
FIG. 2 shows a cross-section on a line 1—1 through an exterior sealed frame, triple-glazed door panel made from composite plastic extrusions in which the glazing sheets are held in position using a combination of thermoplastic and thermosetting sealants.

FIG. 2 shows a cross-section of a sealed frame, triple-glazed panel 21. The perimeter frame 26 is assembled from rigid plastic, stepped-frame profiles 30 that are joined together and sealed at the corners. Glazing sheets 23 and 24 overlap the perimeter frame 26 and are adhered to the frame using sealant material 33. A third glazing sheet 25 is located between the two outer glazing sheets 23 and 24, and this third glazing sheet 25 is similar in shape but smaller in size than the center two glazing sheets 23 and 24.

The glazing sheets 23, 24 and 25 are typically made from heat strengthened or tempered glass. For optimum thermal performance, the width of the glazing cavity spaces 41 and 42 between the glazing sheets 23, 24 and 25 is typically about 12.5 mm (½ inch ). For further improved energy efficiency, a low-e coating 51 can be applied to one or more of the glass cavity surfaces of the glazing panel 21. In addition, the cavity spaces 41 and 42 between the glazing sheets 23, 24 and 25 can accommodate a low conductive gas such as argon or krypton.

For triple-glazed panels, one major advantage of the stepped frame profile is improved condensation resistance. The bottom edge cold air convection currents 57 within the outer glazing cavity 41 do not coincide with the bottom edge cold air convection currents 58 within the inner glazing cavity 42. As a result, bottom edge glazing temperatures can be quite significantly increased.

The rigid plastic profiles 30 can be made from various materials using various different production processes. As illustrated in FIG. 2, the stepped frame profiles 30 are made from thermoplastic extrusions 31 that are heat welded at the corners. Various thermoplastic materials can be used, and one preferred material is glass fibre-filled poly vinyl chloride (PVC). Particularly for larger frame assemblies such as doors, the extrusions can be further reinforced with strips of thermoplastic fiberglass pultrusions 32. One key advantage of this composite assembly is increased strength and rigidity. A second key advantage is that the thermal coefficient of expansion of the composite assembly is similar to the thermal coefficient expansion of glass and, as a result, there is minimum stress on the sealant material. The thermoplastic profile extrusion 31 is subdivided into a series of cavities 59, and this provides for additional rigidity and strength as well as improved thermal performance.

An optional barrier film 34 is laminated to the stepped profiles 30, and this film 34 extends from the two top side edges 35 and 36 across the two front faces 37 and 38. The barrier film 34 is also laminated to a tongue shaped portion 39 located between the glazing sheets 24 and 25.

Low permeable sealant 40 is applied continuously to the barrier film 34 creating a continuous barrier of sealant material between the glazing sheets 23 and 24. This low permeable sealant 40 must be non-outgassing and preferred materials include hot melt butyl and polyisobutylene sealants. To remove moisture vapor from the glazing cavity spaces 41 and 42, the low permeable sealant incorporates desiccant fill material 61 with 3A molecular sieve desiccant being the preferred material.

The preferred material for the barrier film 34 is a saran-coated, metallized plastic film that is thermally bonded to the rigid plastic profile. The purpose of the barrier film 34 is to provide a secondary barrier for moisture protection and inert gas retention. However, the use of the barrier film is optional and, assuming that the low permeable sealant 40 can be consistently and accurately applied, there is no need for this secondary barrier protection.

The glazing sheets 23 and 24 are adhered to the framing profile 30 with structural thermosetting sealant 60 that is applied to the bottom portions 43 and 44 of the extended projection 45. Various thermosetting sealant materials can be used and because of proven durability, one preferred material is one or two part silicone sealant. The center glazing sheet 25 is held in position by means of a Z-shaped clip 46 that is held in position by the sealant material 33.

To hide the perimeter edge-seal, decorative plastic film strips 47 and 48 are applied to the perimeter edges 49 and 50 of the glazing sheets 23 and 24. Typically the decorative strips are made from dual tone material with the inner surface being colored black while the outer surface is typically white or another contrasting color.

An additional strip 52 is applied to the perimeter edge 53 of the center glazing sheet 25 and the outward surface is typically a dark color such as black. The top edge of the decorative strip 52 is lined up with the top edges of the outer decorative strips 47 and 48. When viewed at an oblique angle, the dark colored surfaces visually merge together creating the visual illusion of a solid profile and as a result, the stepped portion of the frame is not visually noticeable.

The decorative strips 47 and 48 can be made from various materials, and one preferred material option is polyethylene terephthalate (PET) plastic film that is double coated with fluoroelastomer paint. The strips 47 and 48 are adhered to the outer perimeter edges 49 and 50 of the glazing sheets 23 and 24 with acrylic pressure sensitive adhesive 56. A second preferred material option is to produce the strips from fluoro-elastomer coatings that are directly applied to the glass. For color matching, the exposed outer surfaces of the plastic profile 30 can also be coated with the same fluoro-elastomer coatings used for the strips.

Figure 3:
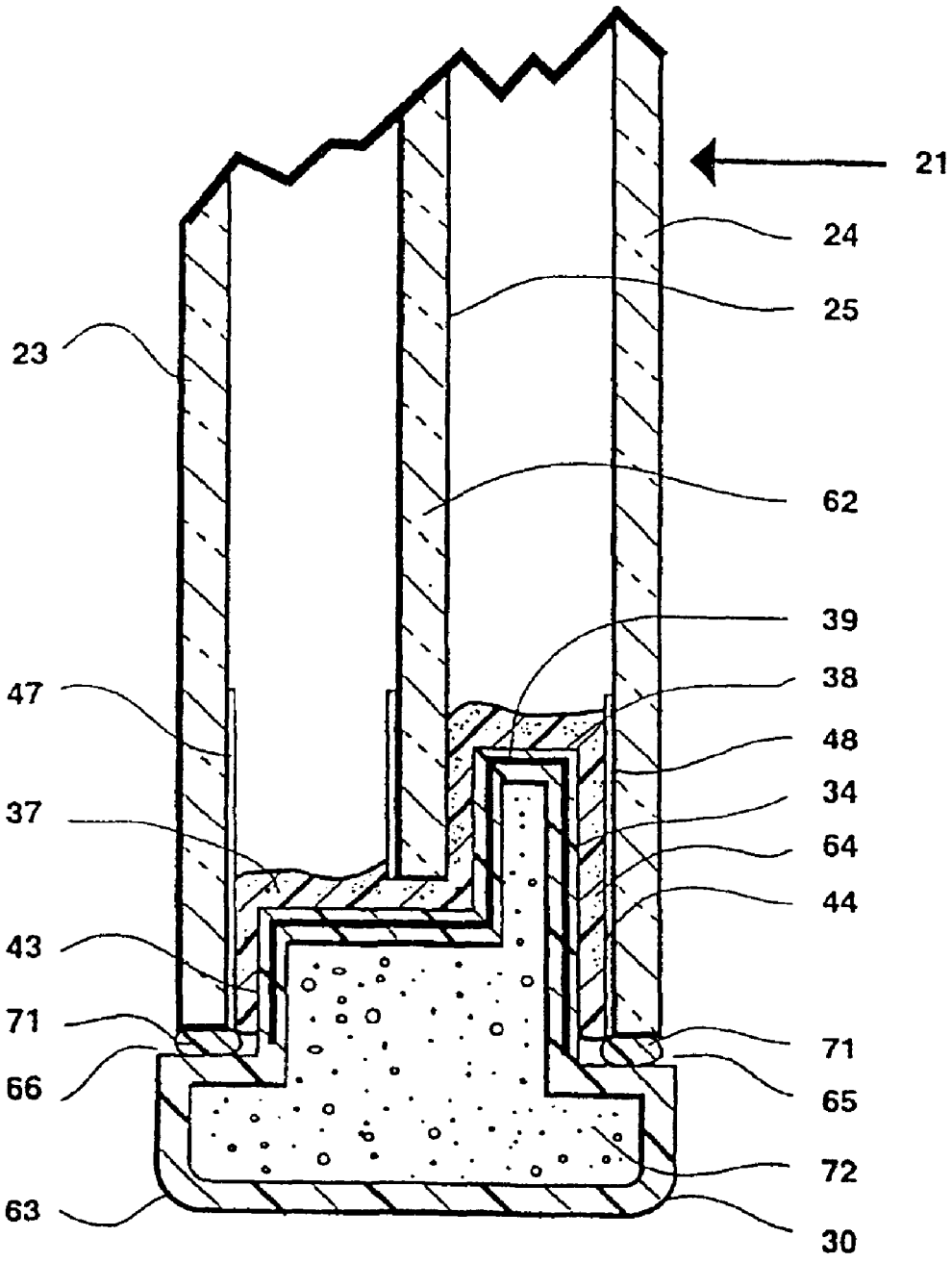
FIG. 3 shows a cross-section on line 1—1 through an exterior sealed frame, triple-glazed panel made from pultruded fibreglass profiles, in which the glazing sheets are held in position using thermoplastic/thermosetting sealant.

FIG. 3 shows a sealed frame, triple-glazed door panel 21 that is similar in construction to the door panel illustrated in FIG. 2, but the assembly incorporates a series of alternative materials and sub components.

For example, the center glazing sheet 25 is a rigid transparent plastic sheet 62. In comparison with conventional glass, the advantage of using a rigid plastic center glazing is that it provides for improved security protection and hurricane resistance. The plastic sheet can be made from various materials including polycarbonate and acrylic sheet.

The rigid plastic profiles 30 are made from a thermoplastic polyurethane glass fibre pultrusion 63 that is marketed by Dow Plastics under the trade name of Fulcrum. The glass fibre content of the thermoplastic pultruded material can be as high as 80 per cent. As a result, the material is very stiff and rigid with the coefficient of thermal expansion being very similar to that of glass. Hollow pultruded profiles 63 are connected together with corner keys and are thermally bonded at the corners to ensure a long term, durable seal. For improved thermal performance, the hollow profiles 63 are filled with low density insulating foam 72.

An optional barrier film 34 can be laminated and adhered to the hollow profile using pressure sensitive adhesives. Alternatively, the barrier film 34 can be applied during the pultrusion process, and this has an advantage in that the film can be coated with a thin layer of polyurethane material which helps ensure that the film cannot be accidentally damaged or punctured prior to the assembly of the sealed frame panel.

Instead of using a combination of thermoplastic and structural thermosetting sealant, a single thermoplastic/thermosetting sealant 64 can be used. The key advantage of using a single material is that automated sealant application is greatly simplified. With the stepped triple-glazed profile, the sealant is continuously applied from the bottom side edges 43 and 44, across the front faces 37 and 38 on the tongue portion 39. Various thermosetting/thermoplastic sealant materials can be used including reactive hot melt butyl, modified silicone, and modified polyurethane materials. In all three cases, the sealant is applied as a hot melt thermoplastic material, but over time, the sealant chemically cures as a thermosetting material. The sealant material incorporates desiccant fill material and one preferred material is Delchem D-2000 reactive hot melt butyl that is produced by Delchem of Wilmington, Del. To protect the sealant from direct UV exposure, silicone sealant beads 71 can be applied in the gaps 65 and 66 between the bottom glass edges and the framing profiles.

The decorative pattern strips 47 and 48 are located on the inner face of the glazing sheets 23 and 24. The decorative strips 47 and 48 are made from ceramic frit material that is bonded to the glass at high temperatures.

Although the perimeter frame is typically assembled from rigid plastic profiles, it can be appreciated by those skilled-in-the-art that the frame can also be manufactured as one piece using injection molding production processes. The main drawback is the high cost of the large molds which means in effect that only a very limited number of standard sizes can be cost effectively manufactured.

FIG. 4 illustrates the main production steps involved in the assembly of the sealed frame, triple-glazed panel illustrated in FIG. 3.

Figure 4A:
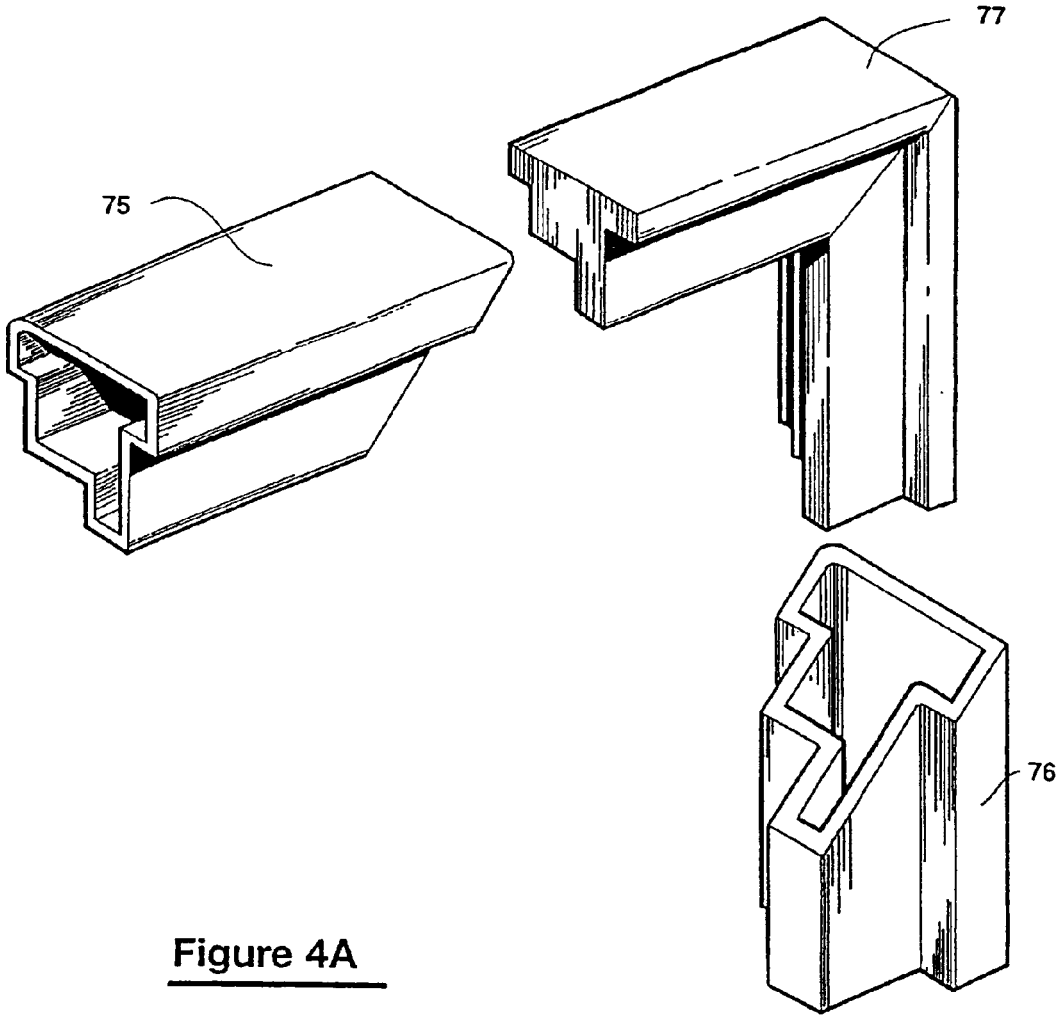
FIG. 4A shows an exploded perspective view of the corner frame assembly constructed using thermoplastic pultruded profiles.

FIG. 4A shows an exploded perspective corner view of two hollow thermoplastic pultruded profiles 75 and 76 that have been miter cut and are then joined together with a tight fitting corner key 77. To provide for a durable and long term hermetic seal, the thermoplastic corner key 77 can be bonded to the thermoplastic frame profiles 75 and 76 and this can be achieved using various production techniques, including electromagnetic welding and magnetic heat sealing.

Figure 4B:
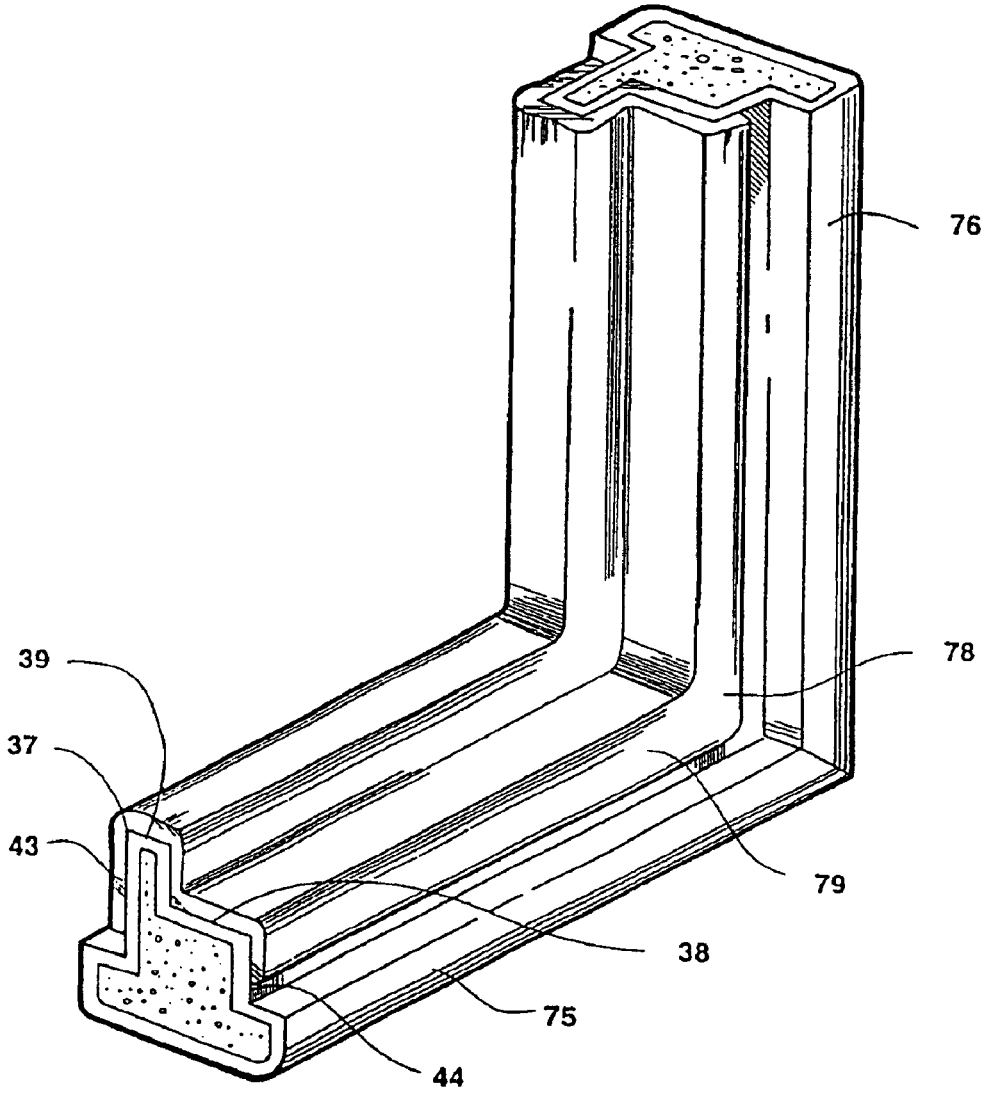
FIG. 4B shows a perspective view of the corner frame assembly with applied sealant and desiccant matrix.

FIG. 4B shows a perspective view of the corner frame assembly where thermoplastic/thermosetting sealant is continuously applied from the bottom side edges 43 and 44, across the front faces 37 and 38 and the tongue portion 39 of the hollow profiles 75 and 76. Using special robotic heads, the sealant is extruded around the complex profile shape. At the corner, the robotic head moves out and then rotates through 90 degrees. Typically, this turning operation results in excess sealant 78 in the corners, but because the corners are the weak link in edge seal integrity, this excess corner sealant is generally advantageous. On the side faces 79 at the corners, it is difficult to achieve consistent sealant thickness and so a secondary smoothing operation may be required to achieve uniform application.

Figure 4C:
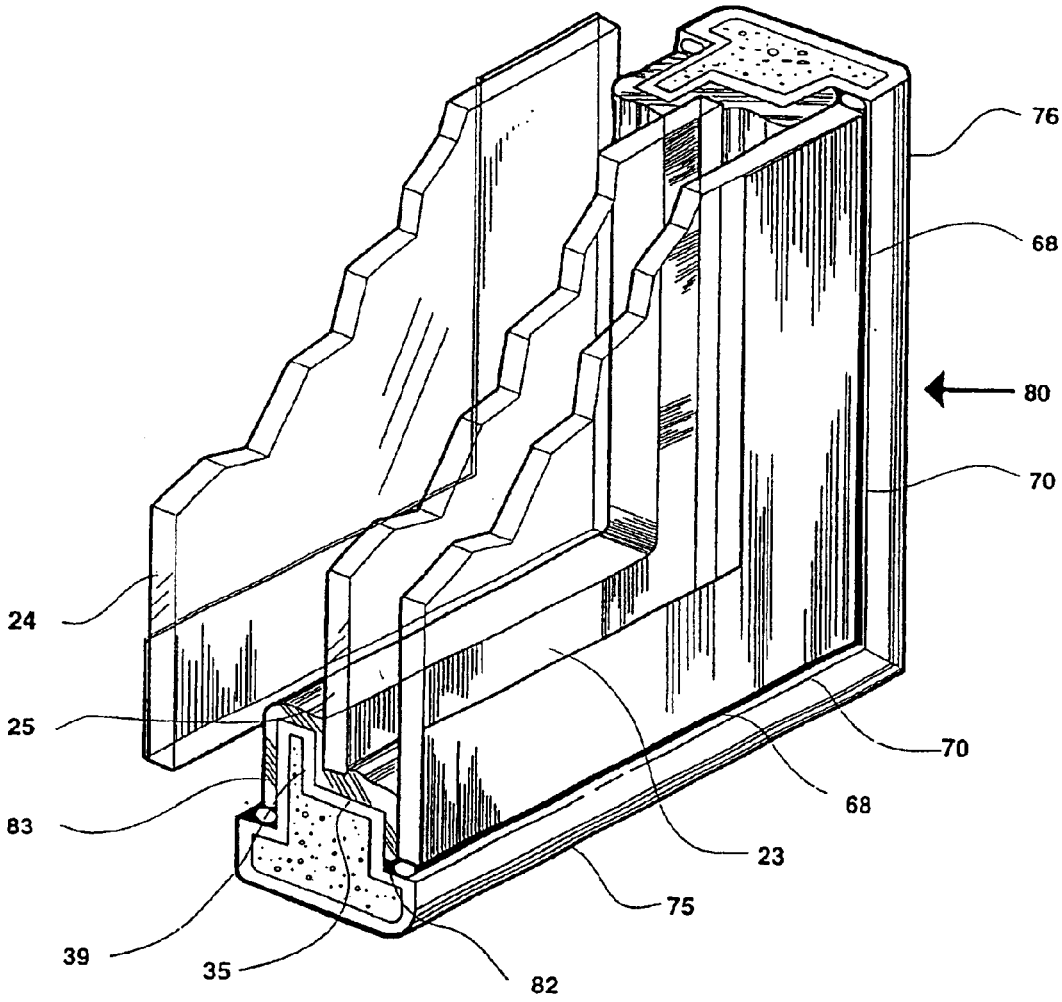
FIG. 4C shows an exploded perspective view of the corner frame assembly with overlapping glass sheets.

FIG. 4C shows a partially exploded perspective view of the corner frame assembly in which the center glazing sheet 25 is matched with the frame assembly 80. The glazing sheet 25 overlaps the tongue portion 39 of the framing profiles 75 and 76. Using robotic automated equipment, the center glass sheet 25 is very accurately located so that the sealant on the front face 35 is not disturbed and seal integrity is maintained. A second (outer) glass sheet 23 is also accurately positioned against the side wall 82 with the glass sheet edges 68 being located a uniform distance from the outer profile ledges 70. The glass/frame subassembly is then rotated through 180 degrees and a third (inner) glass sheet 24 is then accurately positioned against the side wall 83 using automated robotic equipment.

After the glazing sheets 23 and 24 have been accurately matched, the thermoplastic/thermosetting sealant is then fully wet out by applying heat and pressure to the sealant material. As well as wetting out the sealant, the heat and pressure also increases the structural bond strength and also initiates the curing process. Depending on the profile shape, either a conventional roller press can be used or alternatively the thermoplastic sealant can be wet out by means of pressure rollers that automatically move around the perimeter edge of the glazing sheets 23 and 24.

After the triple glazing panel has cooled down, the sealed cavities are filled with an inert gas, such as argon or krypton. Both the inner and outer fill holes through the hollow profile are plugged and typically, these plugs are made of thermoplastic material that can be thermally welded to the thermoplastic profile. Compared to a conventional window frame assembly, a key advantage of sealed frame construction is that for operable windows and doors, it is feasible for the panels to be easily refilled on site so there is no thermal performance degradation due to long term gas loss.

Figure 5A:
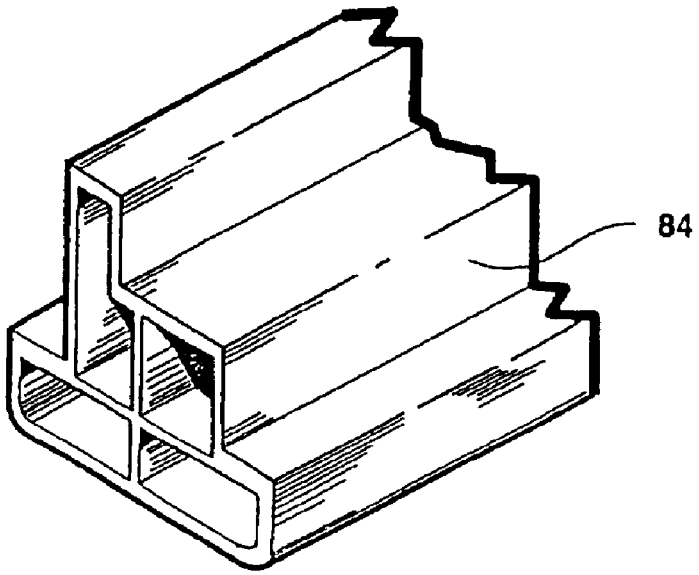
FIG. 5A shows a perspective cross-section detail for a triple-glazed door frame made from glass fiber filled thermoplastic extrusions.
Figure 5B:
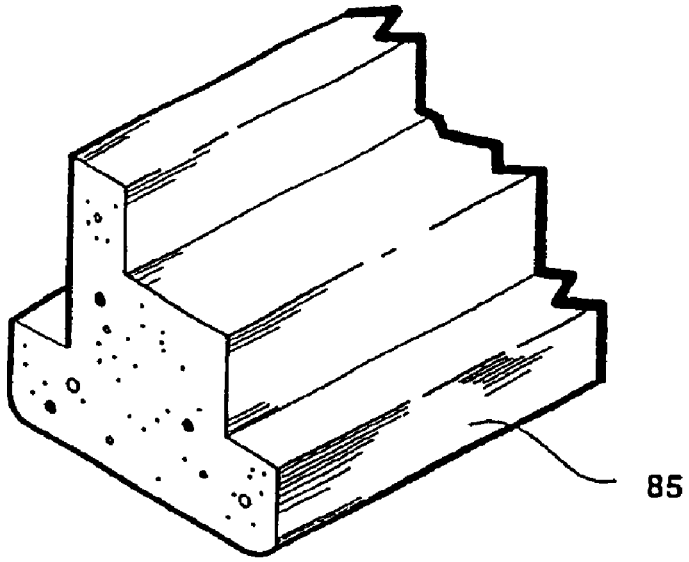
FIG. 5B shows a perspective cross-section detail for a triple-glazed door frame made from structural foam, glass fiber filled thermoplastic extrusions.
Figure 5C:
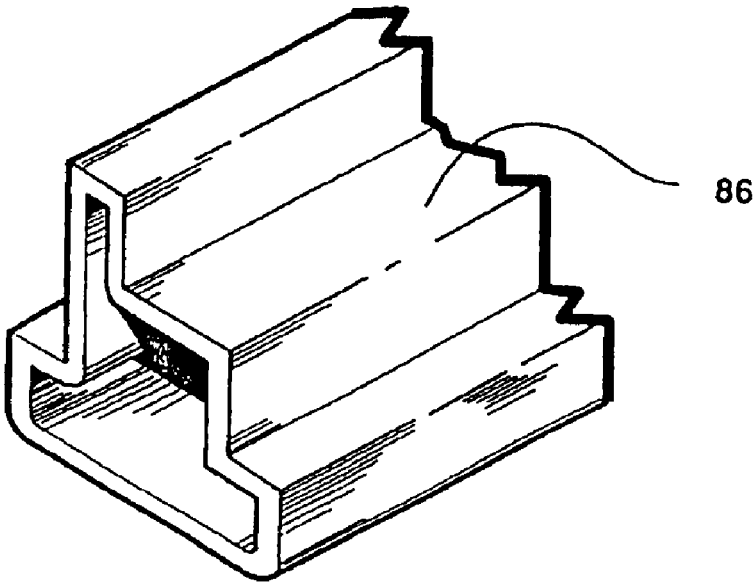
FIG. 5C shows a perspective cross-section detail for a triple-glazed door frame made from thermoset fibreglass pultrusions.
Figure 5D:
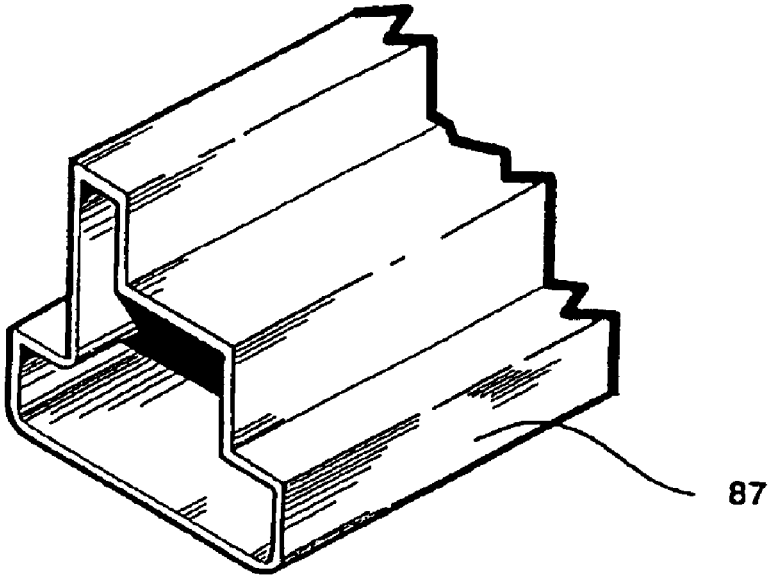
FIG. 5D shows a perspective cross-section detail for a triple-glazed door frame made from oriented plastic extrusions.

For fabricating the perimeter rigid frame profiles, various other plastic materials and production processes can be used. As shown in FIG. 5A, the profile 84 can be extruded from a glass fibre-filled thermoplastic material. One preferred product material is glass fiber-filled polyvinyl chloride (PVC) plastic with the glass fibre content varying between 10 and 30 per cent, and one supplier of this product is Polyone of Cleveland, Ohio who produces this product under the trade name of Fiberlock. As shown in FIG. 5B, the profile 85 can be extruded from glass fibre re-enforced, thermoplastic, structural foam materials such as polycarbonate or polyimides. As shown in FIG. 5C, the profile 86 can also be pultruded from a thermoset plastic, glass fibre composite material. Compared to thermoplastic pultrusions, the main drawback of thermoset pultrusions is the need to achieve reliable hermetic corner sealing using conventional sealant materials. Finally, as illustrated in FIG. 5D, the extruded profile 87 can be made from an oriented thermoplastic material such as polyethylene or polypropylene. During the extrusion process, the thermoplastic material is effectively stretched with the highly oriented material having significantly modified properties such that the thermal coefficient of expansion is somewhat similar to that of glass.

Compared to aluminum and other metals, the four alternative plastic materials have comparatively low thermal conductivities. For example in the case of fibreglass, the thermal conductivity is 0.3 W/m° C. while in comparison the thermal conductivity of aluminum is 160 W/m° C. However, compared to fiber glass pultrusions, the thermal conductivity of other plastic materials is much lower. For example, the thermal conductivity of expanded polystyrene foam is 0.03 W/m° C.

Also, the four alternative plastic materials have a coefficient of expansion somewhat similar to glass and this helps ensure that there is minimum differential expansion between the glass sheets and the rigid plastic profiles.

FIGS. 1 to 5 show the use of sealed frame construction for glass doors where the key advantage is improved energy efficiency through the use of slim-line narrow profile frames. In addition to glass doors, sealed frame construction also offers performance advantages for both fixed and operable windows.

Particularly for overlap casement windows, sealed frame construction offers the advantage that panel width can be reduced and as a result, the overlap window can have a similar width to the outer rigid foam wall insulation. This greatly helps to simplify installation and allows the insulated wall to be sandwiched between the inner and outer frames. As a result, energy efficiency is increased and solar gains are maximized. For example, according to the Canadian energy rating system, a conventional double glazed window can have an ER minus 25 rating, while a high performance double, single overlap window can have an ER plus 25 rating.

Figure 6:
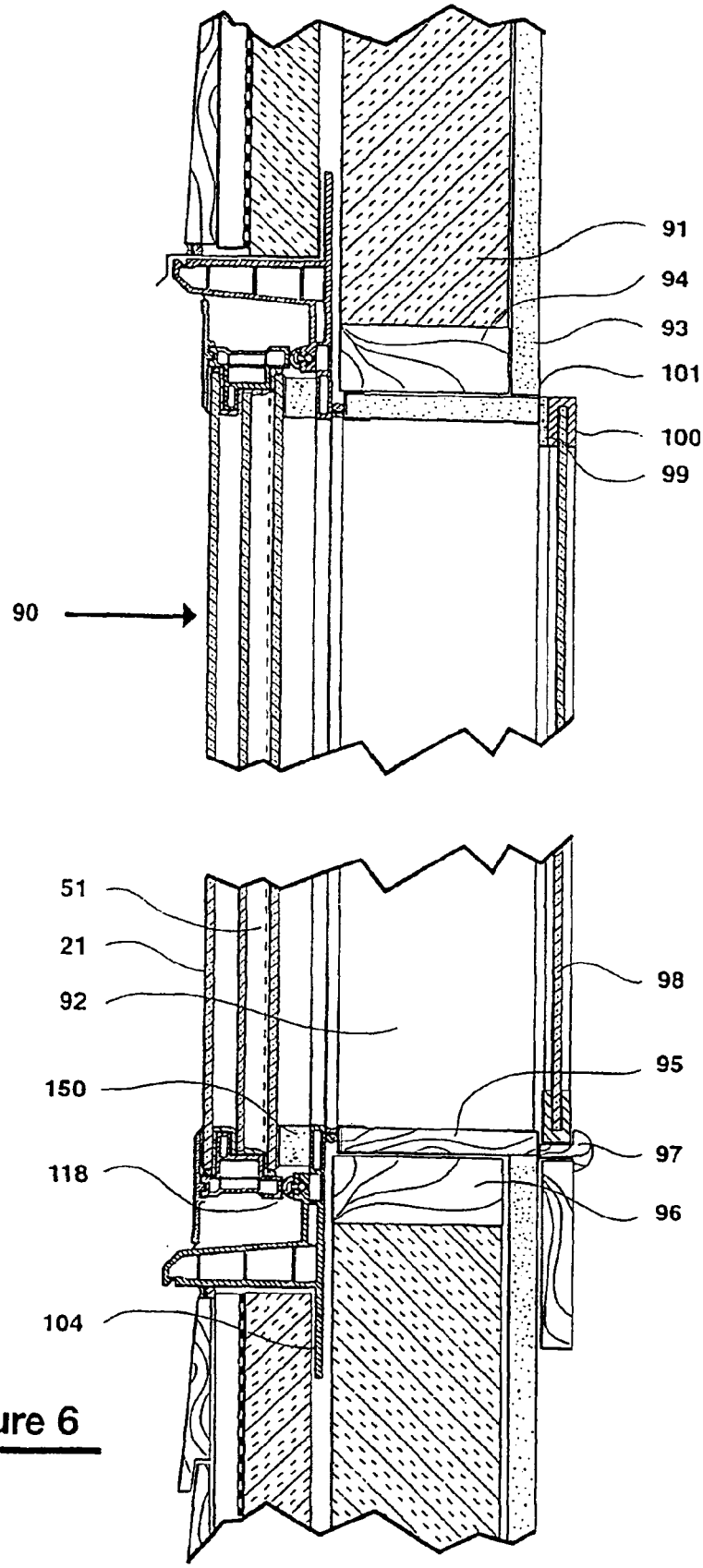
FIG. 6 shows a vertical cross-section of a triple glazed overlap casement window with an interior glazing panel.

FIG. 6 shows a vertical cross-section of an overlapping casement window assembly. For increased energy efficiency, a sealed frame glazing casement window 90 is installed on the exterior side of the insulated wood frame building wall 91, and this window completely overlaps the framed wall opening 92. Plaster dry wall sheeting 93 is directly attached to the wood frame members on the top 94 and sides (not shown) of the opening 92. A wood sill 95 is directly attached to the bottom frame member 96. The wood sill 95 incorporates a channel groove 97 and a single glazed interior panel 98 is supported within the groove. A magnetic flexible rubber gasket 99 is adhered to the perimeter edge 100 of the interior panel 98. When the interior panel 98 is in position, an airtight seal is created between the flexible rubber magnetic gasket and the buried metal dry wall angle 101. In the summer months when the interior glazing panel 98 is removed, there are no visible attachment devices. For further improved energy efficiency, a low-e coating 51 is typically incorporated on surface five of the triple panel 21. A low density EPDM rubber foam extrusion 150 can also be attached to the insect screen support rail 118.

Figure 7:
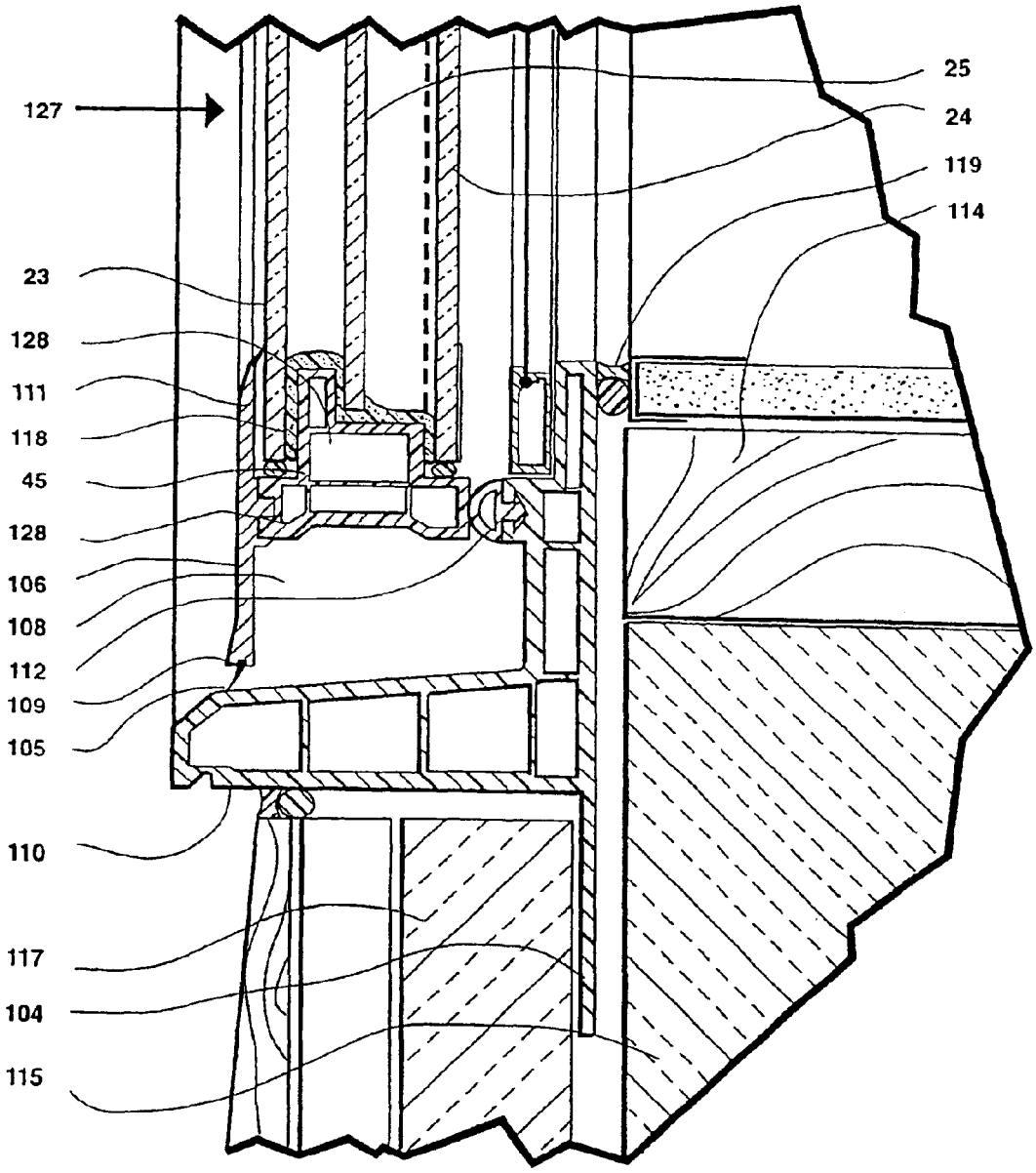
FIG. 7 shows a bottom edge cross-section detail of an overlap casement window.

FIG. 7 shows a bottom cross-section detail of the outer overlap window 127. The casement sash frame 128.1 is fabricated from fibreglass filled PVC extrusions. Glazing sheets 23, 24 and 25 are adhered to the extended projection 45 of sash frame 128.1. The sash frame is supported using specialized integrated overlap window hardware (not shown) that combines the support hinges, multi-point locking devices and window operator into a single integrated component.

The hardware can be operated manually or by means of a single electrical motor.

A flat rigid outer profile 106 is snap fitted to the casement sash frame 128.1 creating a window hardware chamber 108. The outer rain screen weather stripping 105 is also attached to the bottom end 109 of the rigid profile 106. The top end 111 of the rigid profile is a decorative feature that overlaps and hides the perimeter edge seal 118. The rigid profile can be made from a variety of materials including aluminum and pultruded fiberglass.

The main air barrier seal is a conventional EPDM rubber gasket 112. The outer window frame 110 is made from conventional PVC plastic extrusions that are thermally welded at the corners. The outer PVC frame 110 is directly screw fixed to the wood framing member 114 that forms part of the insulated wall construction 115. The bottom leg 104 of the PVC window frame 110 extends outwards for a minimum of 50 mm and is overlapped by the rigid foam insulation 117.

In addition to residential windows and doors, sealed-frame construction also offers advantages for commercial building fenestration systems.

Figure 8:
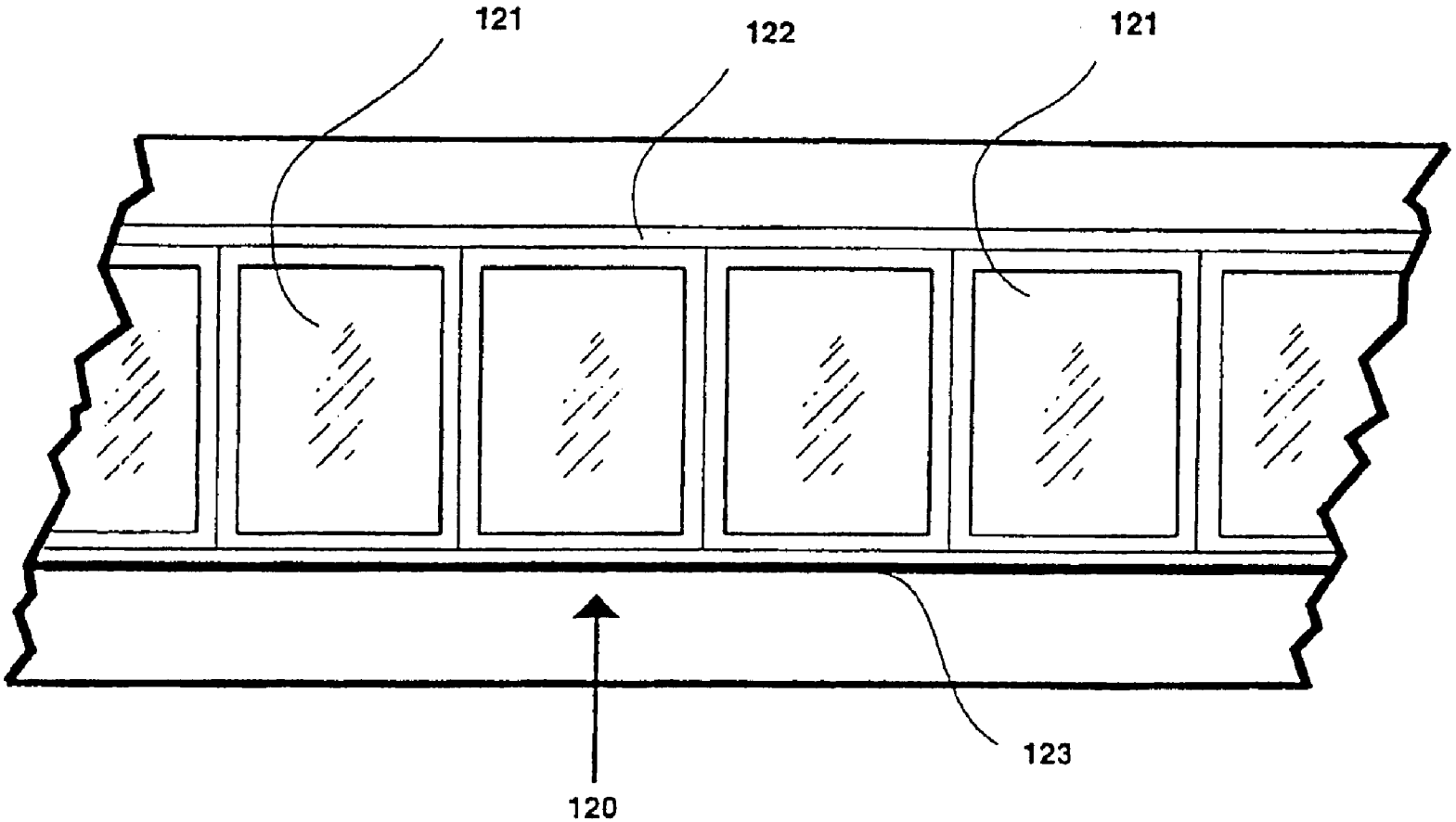
FIG. 8 shows an elevation view of a fixed ribbon window.

FIG. 8 shows an elevation view of a ribbon window assembly 120 for a commercial building, in which the fixed sealed frame, insulating glazing panels 121 span unsupported between a top 122 and bottom frame member 123.

Figure 9:
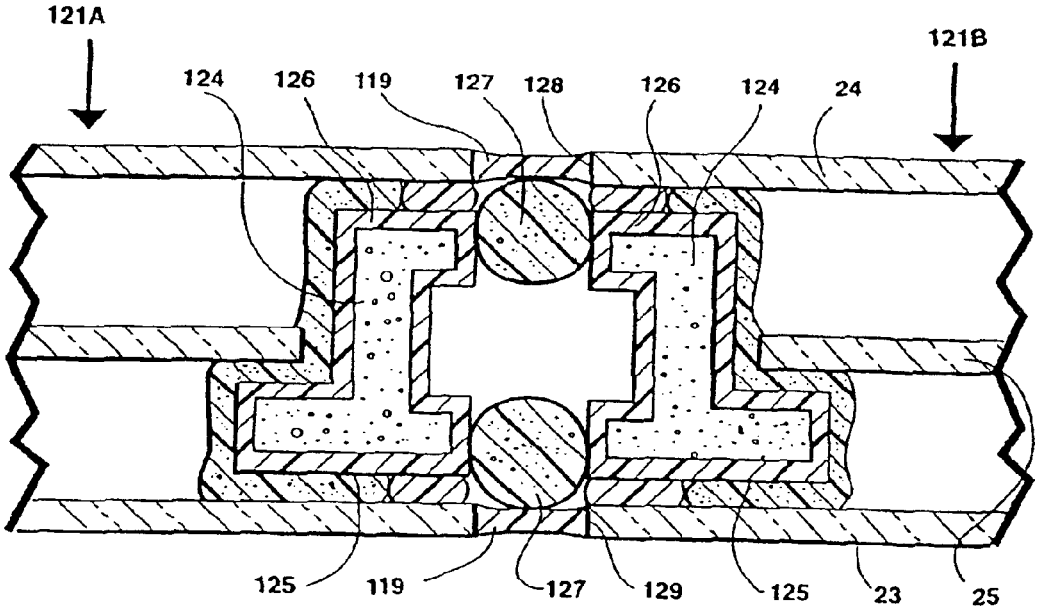
FIG. 9 shows a horizontal cross-section detail for a fixed ribbon window detail featuring sealed frame, triple-glazed panels.

FIG. 9 shows a horizontal cross-section through two adjacent fixed sealed frame, triple glazing panels 121A and 121B each including a stepped frame pultruded fibreglass profile 124. The wider face 125 of the stepped profile is on the exterior side of the building while the narrower face 126 is on the interior side. The inner 24, outer 23, and center 25 glazings are adhered to a stepped frame profile 124 creating a stiff panel assembly that can span unsupported between top and bottom window frame members. Assuming that no special devices like breather tubes are used, and if excessive glass bowing is to be avoided, the maximum overall panel width is about 50 mm. The two glazing panels 121A and 121B are located about 9 mm apart. Polyethylene foam backing rods 127 are located between the glazing panels 121A and 121B. Silicone sealant 119 is used to seal both the inner 128 and the outer 129 joints creating a clean uncluttered band of glass on both the interior and exterior of the building.

Even though a 50 mm wide stressed skin glass panel is comparatively stiff, especially when fabricated with rigid fibreglass profiles 124, the maximum span of the panel between the top and bottom supports 122 and 123 is about 1.5 m with the maximum spacing being dependent on such factors as local wind exposure, glass thickness and panel size.

Figure 10:
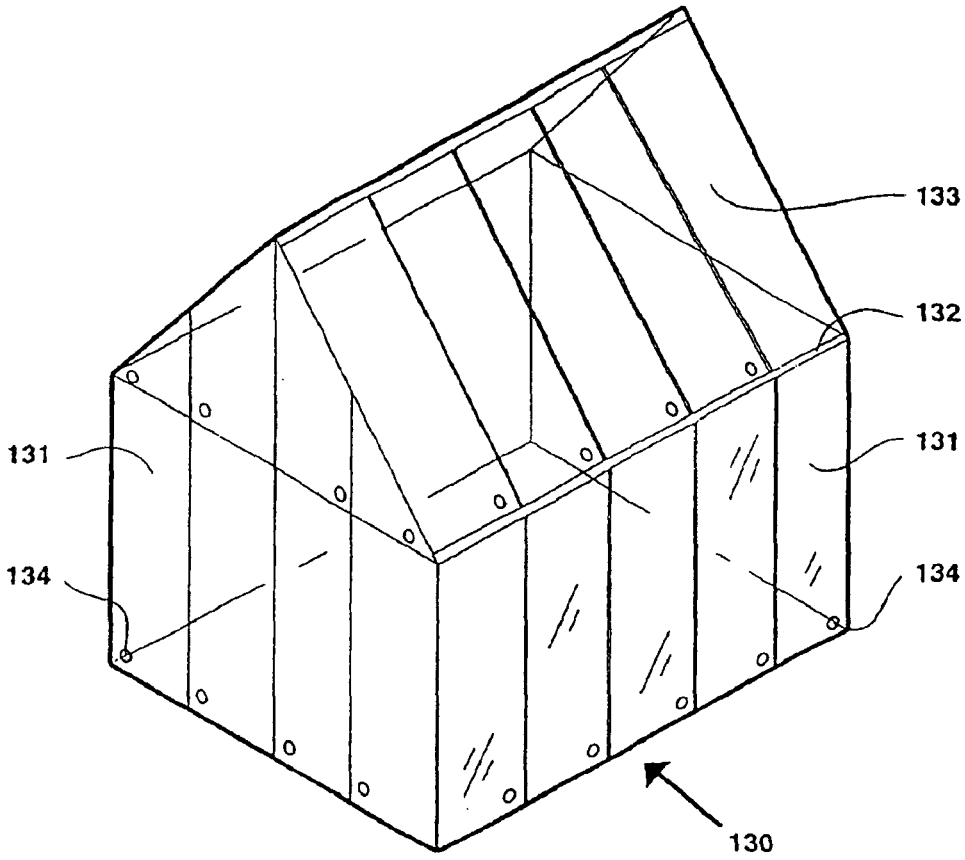
FIG. 10 shows an isometric view of an attached glass sunroom constructed using sealed frame, double-glazed, stressed skin panels.
Figure 11:
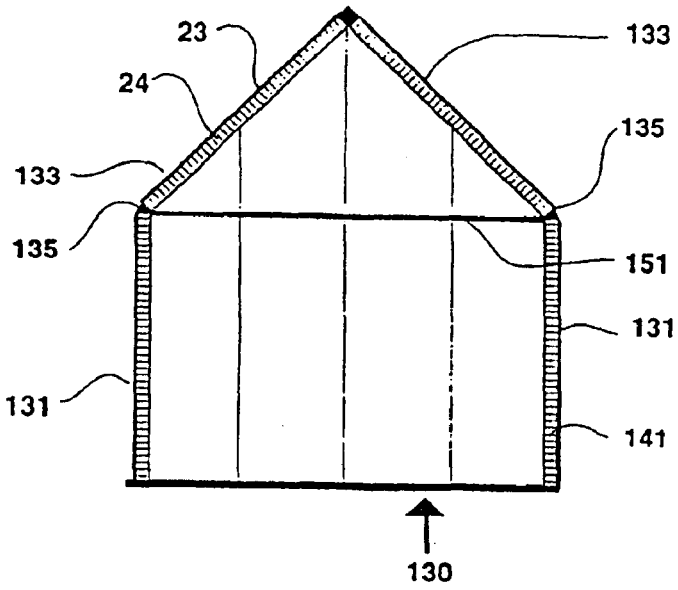
FIG. 11 shows a cross-section of an attached glass sunroom constructed using sealed frame, double-glazed, stressed skin panels.
Figure 12:
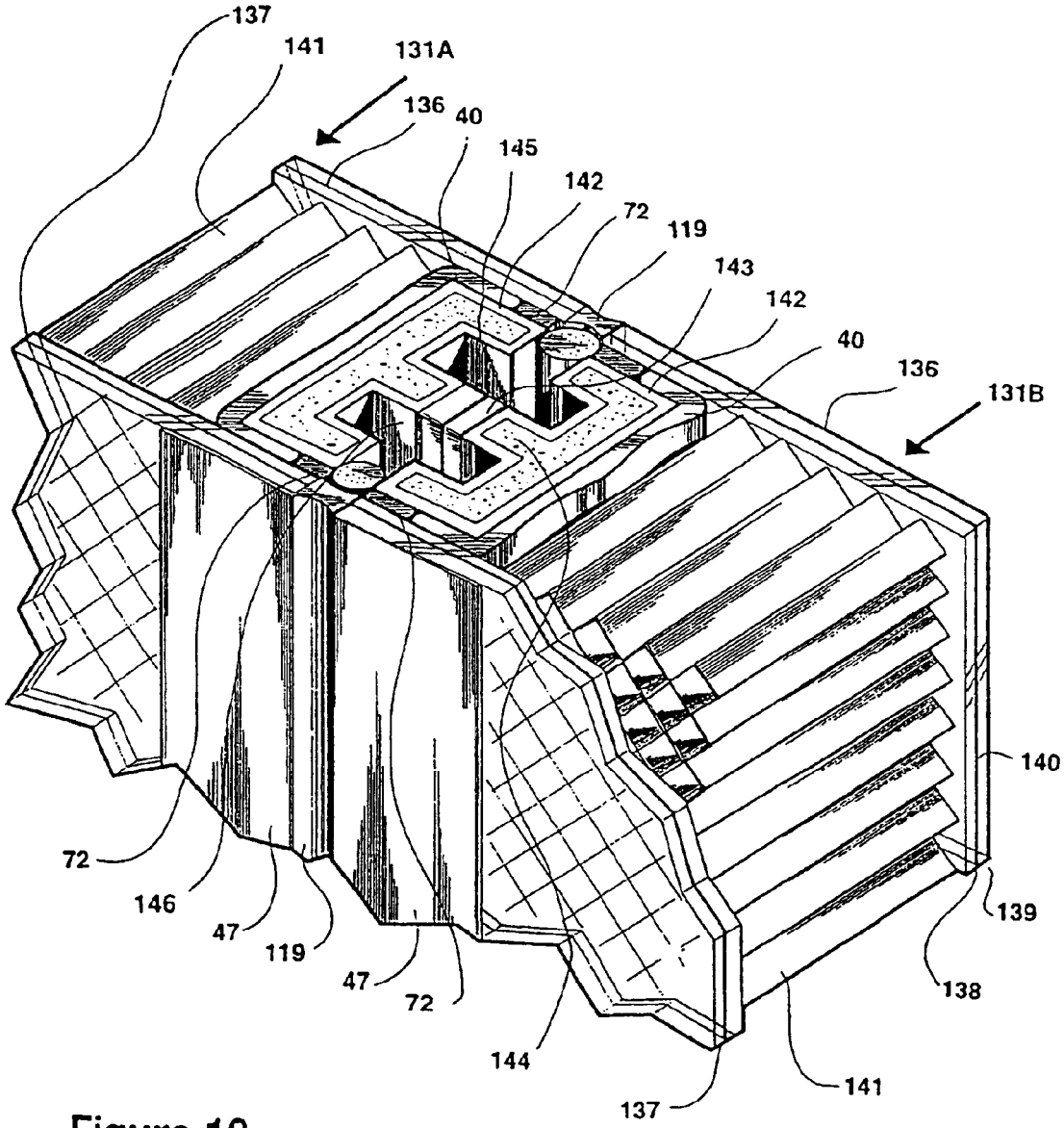
FIG. 12 shows a cross-section perspective view of the joint between two sealed frame, double-glazed, stressed skin panels.

FIGS. 10, 11, and 12 illustrate a stressed skin glazing panel construction in which the width of the stressed skin panels are greater than 50 mm. With stressed skin panel construction, the glass skins are joined and adhered to the supporting frame so that in combination, the two glass skins and frame structurally act as an integral unit with the two glass skins carrying some of the structural loads so that the combined skin-and-frame assembly has a greater load carrying capacity than if its individual members were installed separately.

FIG. 10 shows an isometric view of an attached sunroom 130 fabricated from stressed skin glass panels. Except for the end panel fascias 132, the combination of the wall and roof panels 131 and 133 create an all-glass exterior and interior look. Each panel incorporates a device 134 that consists of a long thin breather tube filled with desiccant material. As air pressure fluctuates within the sealed unit, air is either sucked in or extracted through the breather tube. The desiccant material within the breather tube dries out the incoming air and ensures that there is no moisture build-up within the stressed skin panels 131 and 134. Eventually, the desiccant material is degraded through moisture build-up and it then has to be replaced on a regular maintenance schedule.

FIG. 11 shows a cross-section through the attached sunroom 130. The stressed skin wall panels 131 fully support the roof panels 133, and there is no separate structural sub frame. To carry the outward tensile forces from the roof assembly, a tensioned steel rod 151 interconnects the two opposite sides of the sunroom at the wall/roof glazing junction 135.

To provide the required structural stiffness, the glazing sheets, 23 and 24 are spaced apart a minimum of 70 mm and preferably at least 100 mm with the spacing varying depending on the sunroom geometry, building size, panel size and local climatic conditions such as winter snow and ice loads.

In designing the glass stressed skin structure, there is a need for some structural redundancy so that if a single glass sheet randomly shatters or breaks, there is no catastrophic structural failure. Consequently, as shown in FIG. 12, the stressed skin glazing panels are constructed from an inner and outer laminated glass sheet 136 and 137 in which each laminated glass sheet is fabricated from a minimum of two separate tempered or heat strengthened glass sheets 138 and 139 that are laminated and adhered together through the use of a PVB inter layer 140.

For optimum thermal performance of a conventional double glazed insulating glass unit, glazing sheets are spaced about 12 to 15 mm apart because if the glazing sheets are spaced wider apart, there is increased convection flow within the glazing unit and thermal performance is downgraded. One way of dampening convection flow and increasing energy efficiency is through the use of honeycomb convection suppression devices. One preferred convection suppression device 141 is manufactured by *Advanced Glazings* of Sydney, Nova Scotia. The product is marketed under the name InsolCore.® The product is made from flexible polypropylene plastic film that is heat welded together to form a honeycomb convection suppression device that is suspended between the two glazing sheets.

FIG. 12 shows a perspective cross-section view of the joint between two stressed skin glass panels. The panels are fabricated from two laminated glazing sheets 136 and 137 that are spaced apart by hollow, foam-filled, E-shaped, pultruded fibreglass profiles 142. The laminated glazings are adhered to the profiles using a combination of structural silicone sealant 72 and low permeable, desiccant-filled sealant 40 such as modified silicone sealant or reactive hot melt butyl. Typically, the sealant material is protected from direct UV exposure by decorative strips 47 and 48 (not shown).

The front face of the profile is coated with low permeable, desiccant filled sealant material. An alternative option is to laminate flat strips of impervious gas/moisture barrier material to the front face of the rigid profile and then continuously overlap these flat strips at the side edges and corners with the same low permeable sealant that is also applied to the side edges.

The two panels 131A and 131B are spaced about 9 mm apart. Both the interior and exterior joints are sealed with silicone sealant 119. Flexible foam strips 143 are attached to both center tongues 144 of the E-shaped profiles 142 creating two separate cavity spaces 145 and 146.

It should be understood that for purposes of clarity, certain features of the invention have been described in the context of separate embodiments. However, these features may also be provided in combination in a single embodiment. Furthermore, various features of the invention which for purposes of brevity are described in the context of a single embodiment may also be provided separately or in any suitable sub-combination in other embodiments.

Moreover, although particular embodiments of the invention have been described and illustrated herein, it will be recognized that modifications and variations may readily occur to those skilled in the art, and consequently it is intended that the claims appended hereto be interpreted to cover all such modifications and equivalents

What is claimed is:

1. A structural panel comprising:

a rectangular frame including a plurality of interconnected straight rigid plastic profile portions arranged in a rectangular configuration;

a first rectangular laminated glass sheet arranged at a first side of said rectangular frame;

a second rectangular laminated glass sheet arranged at a second side of said rectangular frame opposite said first side such that said first rectangular laminated glass sheet is spaced apart from said second rectangular laminated glass sheet by at least 70 mm, each of said first rectangular laminated glass sheet and said second rectangular laminated glass sheet having a peripheral band portion overlapping said profile portions so as to form a continuous peripheral engagement between said first rectangular laminated glass sheet and said rectangular frame, and between said second rectangular laminated glass sheet and said rectangular frame; and a structural thermosetting silicone sealant between said rectangular frame and said peripheral band portion of each of said first rectangular laminated glass sheet and said second rectangular laminated glass sheet so as to rigidly attach each of said first rectangular laminated glass sheet and said second rectangular laminated glass sheet to said rectangular frame to form an integral stressed skin panel.

2. The structural panel of claim 1, wherein said plurality of profile portions comprises four profile portions having interconnected ends.

3. The structural panel of claim 1, wherein said rectangular frame is arranged between said peripheral band portion of said first rectangular laminated glass sheet and said peripheral band portion of said second rectangular laminated glass sheet so that no portion of said rectangular frame extends beyond an outer peripheral edge of each of said first rectangular laminated glass sheet and said second rectangular laminated glass sheet.

4. The structural panel of claim 1, further comprising an air passage arranged to allow air to enter into and exit from a cavity formed between said first rectangular laminated glass sheet and said second rectangular laminated glass sheet, said air passage including desiccant material for removing moisture from air entering into said cavity.

5. The structural panel of claim 4, wherein said air passage is formed through one of said first rectangular laminated glass sheet and said second rectangular laminated glass sheet.

6. The structural panel of claim 1, further comprising honeycomb transparent insulation between said first rectangular laminated glass sheet and said second rectangular laminated glass sheet, said honeycomb transparent insulation being formed of a flexible plastic film material.

7. A building enclosure comprising:

a plurality of structural panels arranged as a self-standing building free of any separate structural frame, each of said structural panels comprising:

a rectangular frame including a plurality of interconnected straight rigid plastic profile portions arranged in a rectangular configuration;

a first rectangular laminated glass sheet arranged at a first side of said rectangular frame;

a second rectangular laminated glass sheet arranged at a second side of said rectangular frame opposite said first side such that said first rectangular laminated glass sheet is spaced apart from said second rectangular laminated glass sheet by at least 70 mm, each of said first rectangular laminated glass sheet and said second rectangular laminated glass sheet having a peripheral band portion overlapping said profile portions so as to form a continuous peripheral engagement between said first rectangular laminated glass sheet and said rectangular frame, and between said second rectangular laminated glass sheet and said rectangular frame; and a structural thermosetting silicone sealant between said rectangular frame and said peripheral band portion of each of said first rectangular laminated glass sheet and said second rectangular laminated glass sheet so as to rigidly attach each of said first rectangular laminated glass sheet and said second rectangular laminated glass sheet to said rectangular frame to form an integral stressed skin panel.

8. The building enclosure of claim 7, wherein said plurality of profile portions of each of said structural panels comprises four profile portions having interconnected ends.

9. The building enclosure of claim 7, wherein said rectangular frame of each of said structural panels is arranged between said peripheral band portion of said first rectangular laminated glass sheet and said peripheral band portion of said second rectangular laminated glass sheet so that no portion of said rectangular frame extends beyond an outer peripheral edge of each of said first rectangular laminated glass sheet and said second rectangular laminated glass sheet.

10. The building enclosure of claim 7, wherein each of said structural panels further comprises an air passage arranged to allow air to enter into and exit from a cavity formed between said first rectangular laminated glass sheet and said second rectangular laminated glass sheet, said air passage including desiccant material for removing moisture from air entering into said cavity.

11. The building enclosure of claim 10, wherein said air passage of each of said structural panels is formed through one of said first rectangular laminated glass sheet and said second rectangular laminated glass sheet.

12. The building enclosure of claim 7, wherein each of said structural panels further comprises honeycomb transparent insulation between said first rectangular laminated glass sheet and said second rectangular laminated glass sheet, said honeycomb transparent insulation being formed of a flexible plastic film material.

* * * * *